US005190026A

United States Patent [19]

Doty

[11] Patent Number: 5,190,026

[45] Date of Patent: Mar. 2, 1993

[54] MODULAR COUNTERTOP COOKING SYSTEM

[75] Inventor: Roger F. Doty, Connersville, Ind.

[73] Assignee: Maytag Corporation, Newton, Iowa

[21] Appl. No.: 794,461

[22] Filed: Nov. 19, 1991

[51] Int. Cl.[5] ..... F24C 3/00

[52] U.S. Cl. ..... 126/39 R; 126/39 B; 126/41 R; 126/299 D; 219/447

[58] Field of Search ..... 219/447, 454; 126/39 R, 126/39 B, 41 R, 299 D

[56] References Cited

U.S. PATENT DOCUMENTS

| | | | |
|---|---|---|---|
| D. 207,369 | 4/1967 | Field | D81/25 |
| D. 210,336 | 2/1968 | Jenn et al. | D81/25 |
| 3,102,533 | 9/1963 | Jenn et al. | 126/303 |
| 3,367,320 | 2/1968 | Jenn et al. | 126/300 |
| 3,375,819 | 4/1968 | Davis | 126/211 |
| 3,444,805 | 5/1969 | Happel et al. | 99/340 |
| 3,474,724 | 10/1969 | Jenn | 126/41 |
| 3,596,650 | 8/1971 | Cerola | 126/37 R |
| 3,756,217 | 9/1973 | Field | 126/37 R |
| 3,797,375 | 3/1974 | Cerola | 99/340 |
| 3,983,553 | 9/1976 | Kesling | 340/365 R |
| 4,034,663 | 7/1977 | Jenn et al. | 99/446 |
| 4,291,668 | 9/1981 | Moeller | 126/41 R |
| 4,335,705 | 6/1982 | Kurotaki | 126/299 R |
| 4,409,954 | 10/1983 | Berlik et al. | 126/39 |
| 4,413,610 | 11/1983 | Berlik | 126/39 K |
| 4,431,892 | 2/1984 | White | 219/447 |
| 4,562,827 | 1/1986 | Cerola | 126/299 R |
| 4,703,306 | 10/1987 | Barritt | 340/310 CP |
| 4,736,729 | 4/1988 | Beach | 126/39 R |
| 4,821,704 | 4/1989 | Tucker et al. | 126/299 D |
| 4,862,795 | 9/1989 | Hawkins | 99/446 |

OTHER PUBLICATIONS

Siemens Built-In Appliances, publication, Apr.-1991, 4 pages.

Miele built-in appliances, publication, Nov.-1988, 4 pages.

Thermador, "After years of cooking, we've discovered the perfect recipe for making a cooktop." Jul.-1990, 4 pages.

*Primary Examiner*—Carroll B. Dority

*Attorney, Agent, or Firm*—Willian Brinks Olds Hofer Gilson & Lione

[57] ABSTRACT

A modular countertop cooking assembly is provided comprising at least one cooking module and a control module. The cooking module includes a burner box housing, and preferably includes a downdraft ventilation system, and is adapted to operatively receive at least one heating unit within the burner box. The control module is preferably arranged juxtaposed to the cooking module and can provide selective control of the heating units and the ventilation system included in the cooking assembly. The cooking module burner box includes an integral peripheral trim about its top edge and the control module includes an integral peripheral trim about its edge, both of which interface when assembled to provide a flush appearance across their interface and the appearance of a unitary cooking appliance disposed within a countertop. The modularity of the components provided by this invention allows the construction of a single, double, or triple module cooking assembly of variable configuration with reduced tooling and component inventory.

14 Claims, 10 Drawing Sheets

FIG.5A
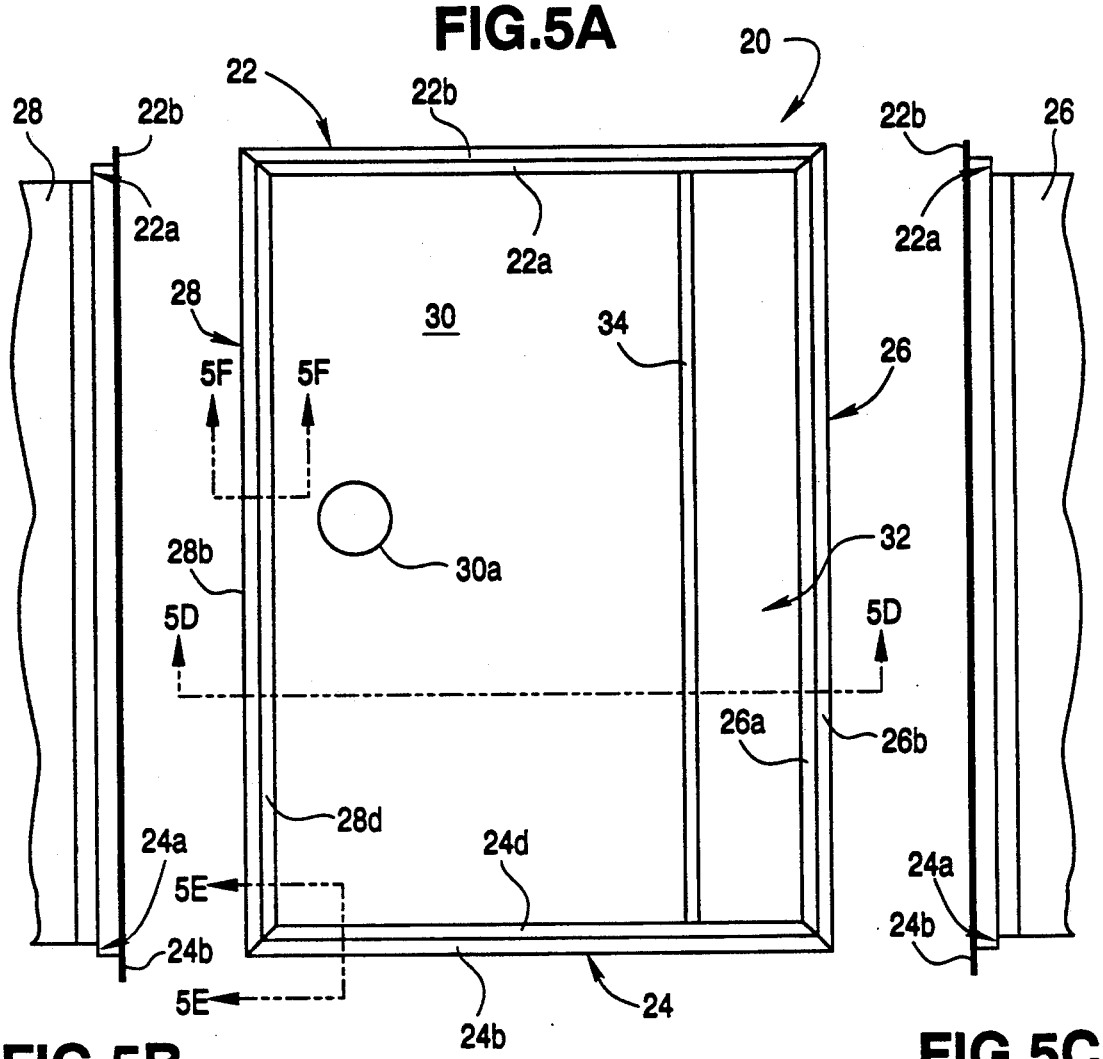
FIG.5B
FIG.5C
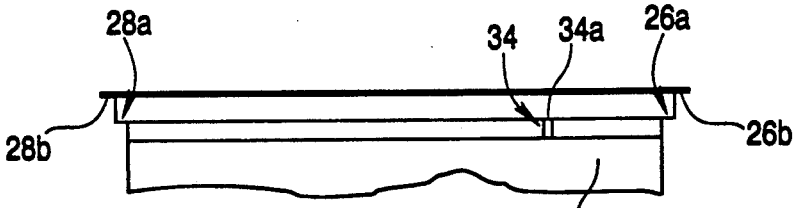
FIG.5D
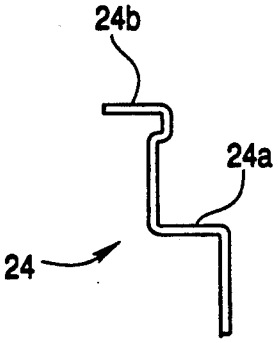
FIG.5E
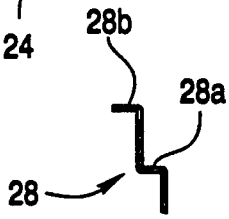
FIG.5F FIG. 12B
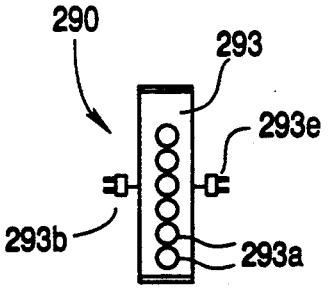
FIG. 12A
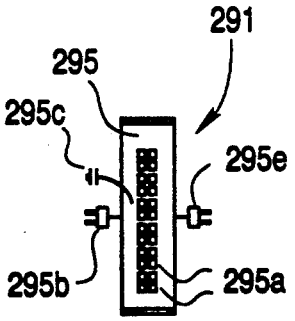
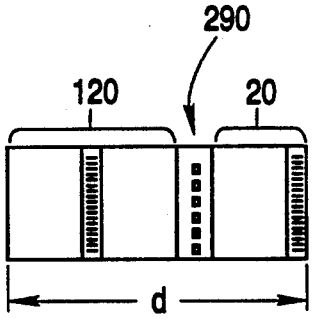
FIG. 12C
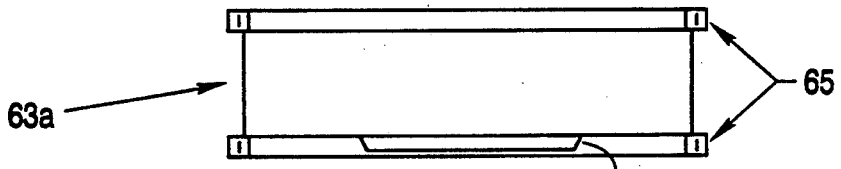
FIG. 14A
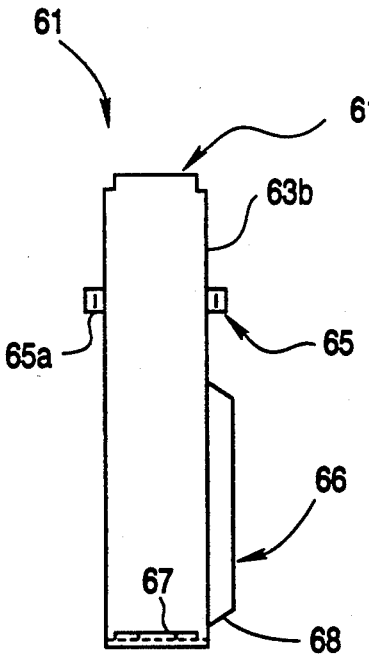
FIG. 14B
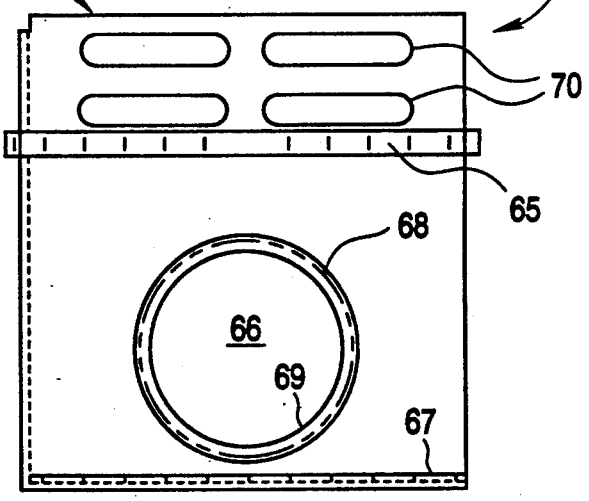
FIG. 14C

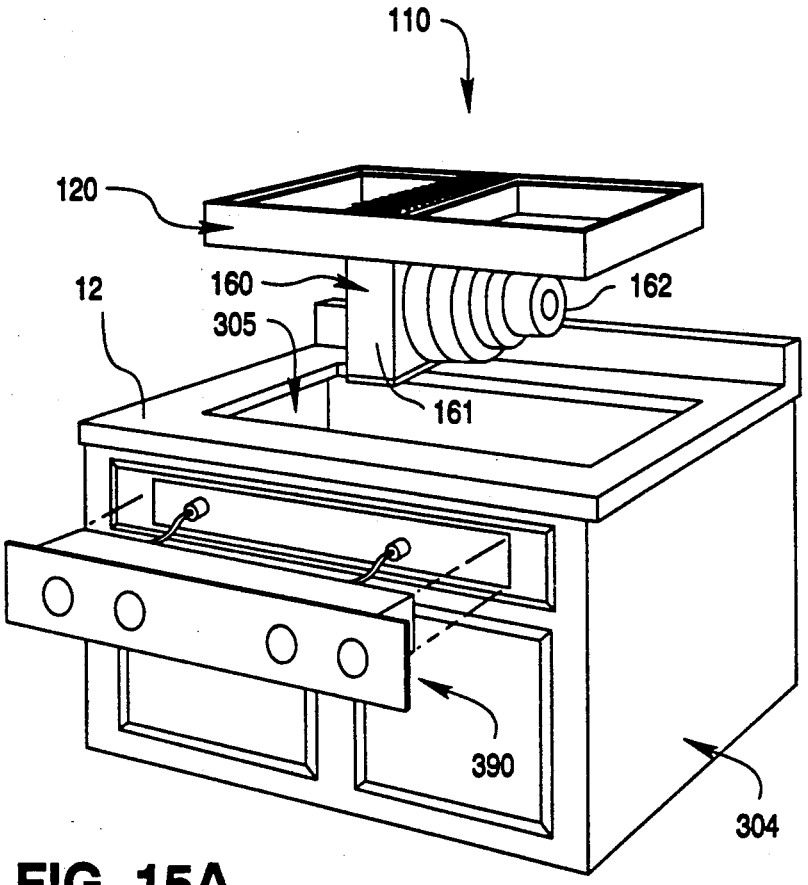
FIG. 15A
FIG. 15B
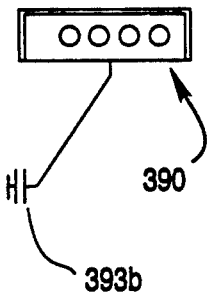

MODULAR COUNTERTOP COOKING SYSTEM

FIELD OF THE INVENTION

This invention relates to countertop cooking assemblies, and, more particularly, to systems for the manufacture of countertop cooking appliances by modular components that may be selectively arranged to construct a cooking appliance of variable configuration and unitary appearance.

BACKGROUND OF THE INVENTION

Various countertop cooking appliances exist in the art today. Jenn, et al., U.S. Pat. No. 3,367,320, teach an electric countertop cooking unit having a centrally located downdraft blower system for capturing and exhausting to atmosphere cooking byproducts and heated air. Davis, U.S. Pat. No. 3,375,819, shows a drop-in gas cooktop unit having provisions for air to enter the space between the cooktop and the bottom burner pan through openings in vertical side flanges.

Happel, et al., U.S. Pat. No. 3,444,805, teach an electric downdraft unit especially for broiling meat. Berlik, et al., U.S. Pat. No. 4,409,954, disclose a gas downdraft range which utilizes modular cartridges to provide a grill unit or a surface burner unit.

U.S. Pat. No. 4,413,610, issued to Berlik, individually, discloses a gas surface range having modular burner cartridges and a downdraft ventilation system, which creates a current or flow of air that travels downwardly away from the cooking surface. The cartridges of Berlik's '610 patent are removable for repairing, cleaning or changing the configuration of the gas range top.

Moeller, U.S. Pat. No. 4,291,668, describes a ventilation apparatus for an indoor grill. U.S. Pat. No. 4,821,704 to Tucker, et al. also describes an indoor cooking ventilation system. Hawkins, U.S. Pat. No. 4,862,795, describes a cooktop grill having an improved reflector pan.

Roper, U.S. Pat. No. 4,562,827, relates to a downdraft countertop cooking range having a panel recessed below the countertop for enhanced accessibility from the front of the range and to exhaust cooking fumes effectively over the entire area of the cooking panel. U.S. Pat. No. 4,736,729 to Beach describes a gas cooking appliance having improved ventilation means.

Further examples of countertop cooking ranges include U.S. Pat. Nos. 3,102,533; 3,474,724; 3,596,650; 3,756,217; 3,797,375; 4,034,663; 4,335,705; D 207,369; and D 210,336.

Built-in countertop cooking appliances are available on the market from such manufacturers as Siemens-Electrogerate GmbH, Munich, Germany; Thermador of Los Angeles, Calif.; and Miele Appliances, Inc. of Somerset, N.J. Thermador manufactures modular cooktops of variable configuration.

The above background art notwithstanding, no prior countertop cooking system has provided modular components that permit the construction of cooking appliances of variable configuration and unitary appearance and that require reduced tooling and inventory.

SUMMARY OF THE INVENTION

The modular countertop cooking system of this invention allows a manufacturer to construct countertop cooking appliances of variable configuration and unitary appearance with less tooling and from a reduced inventory of components. Cooking appliances resulting from use of this invention are most commonly installed in kitchen cabinetworks, including inside or outside wall cabinets, peninsula or island cabinets, and the like.

The basic modular components of the countertop cooking appliance system of this invention comprise a cooking module, including a housing, and preferably a plenum forming means for a ventilation system, and a control module. The cooking module includes an open top burner box, which may be adapted to receive the plenum forming means across the burner box between its faces and to receive one or more heating units juxtaposed to the plenum forming means. The control module includes an elongated enclosure adapted for connection to the sides of the burner box and to carry one or more controls for the heating units and the ventilation system.

The housing of the cooking module can be provided with a peripheral trim about its upper edges, and the control module can be similarly provided with a peripheral trim about its upper edges so that the peripheral trims of the cooking module and of the control module coact to present a flush surface across their interface to provide the appearance of a unitary cooking appliance. The peripheral trim provided on the cooking units and the control unit can also overlie the countertop of the cabinetwork and support the cooking appliance within an opening formed in the countertop surface.

The modularity provided by this invention permits the construction of cooking appliances of variable configuration adapted for updraft and downdraft ventilation by the manufacturer from three or four basic components. The cooking module can comprise a single unit, double unit, or a combination of a single and a double unit. Consequently, the cooking appliances provided by this invention include appliances with single cooking units providing one or two heating units, double cooking units providing two to four heating units, and combined single and double cooking units providing three to six heating units. The modular components and various modular heating and control units allow the manufacturer to combine many options from an inventory of standard modules to construct any one of many desirable cooking systems. Moreover, the modular countertop cooking appliance system of this invention includes components with peripheral trims that act cooperatively to provide the appearance of a unitary cooking appliance.

In a preferred single unit embodiment, the burner box includes an opening provided in the bottom thereof along one side of the burner box to receive a plenum forming means. In a preferred double unit embodiment, the burner box includes an opening provided in the central portion of the bottom of the burner box to receive the plenum forming means therein and is adapted to receive one or more heating units on both sides of the plenum forming means.

In the triple cooking unit embodiment, a double unit cooking unit is operatively combined with a single cooking unit and a control unit to construct an overall cooking appliance having up to two ventilation systems and a single control module.

Figure 5G:
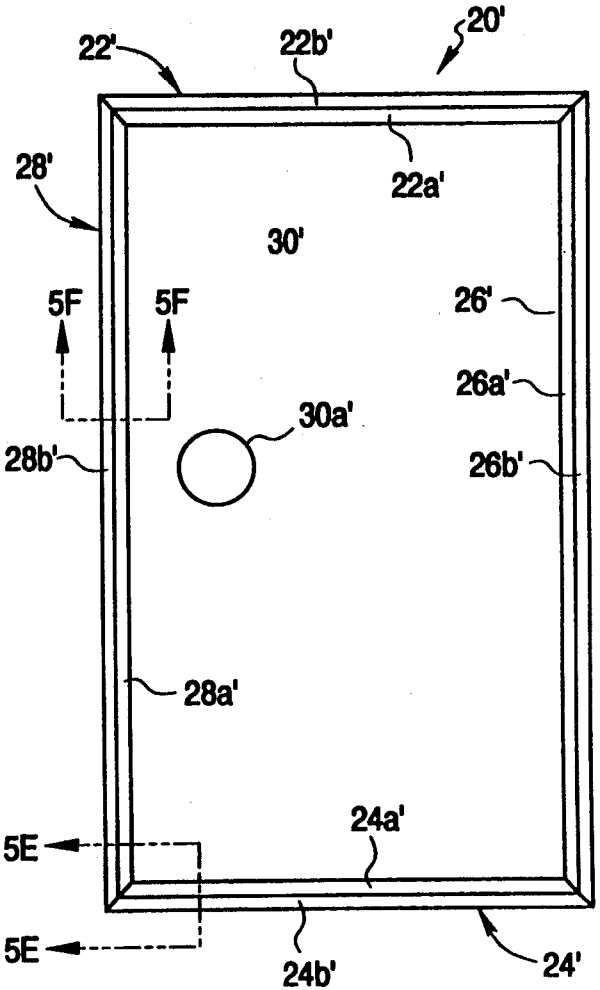
Figure 6:
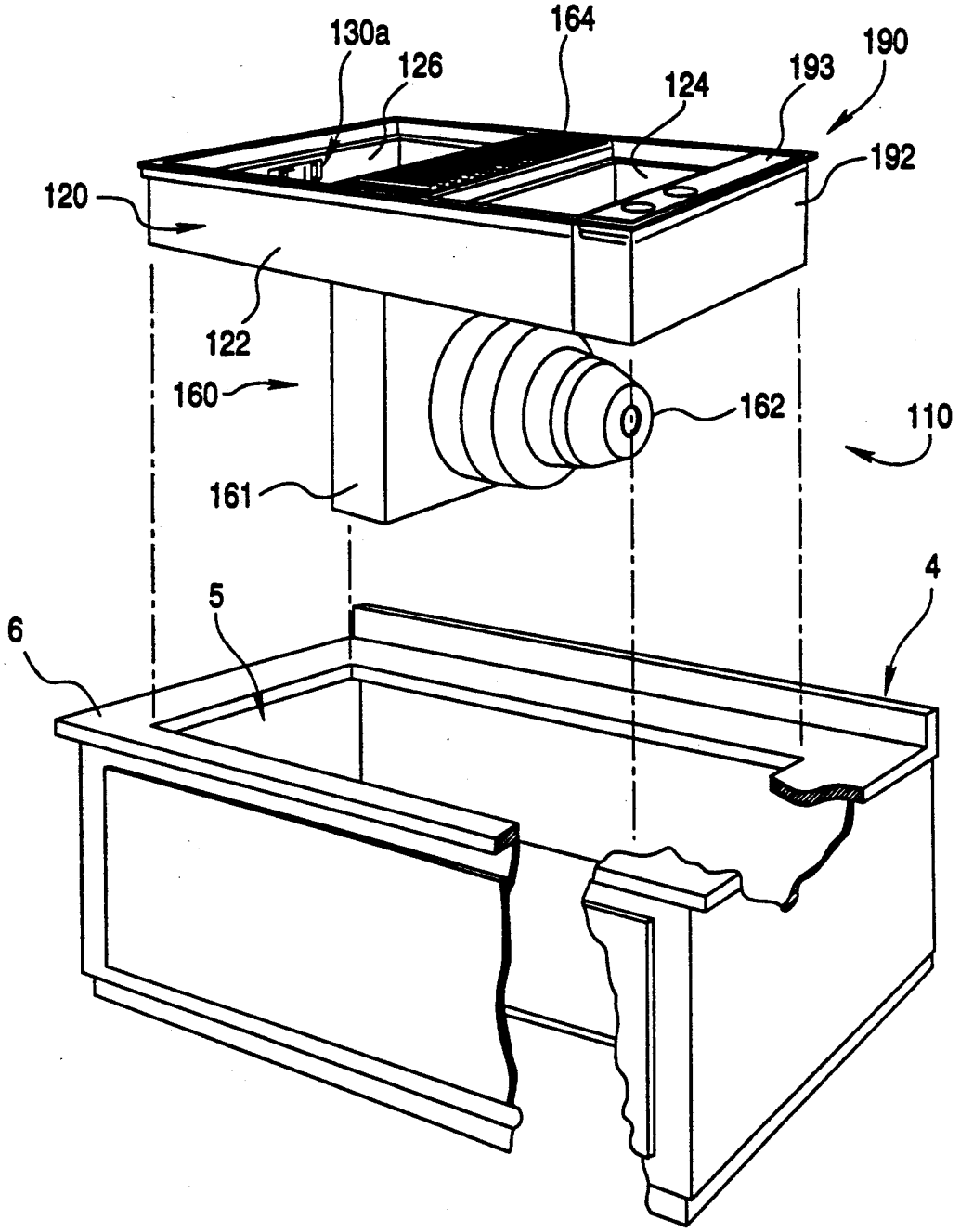
Figure 7:
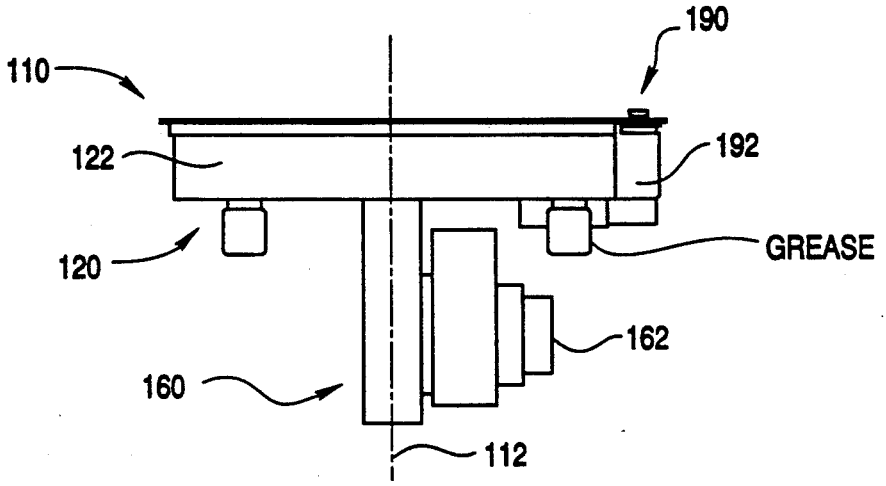
Figures 8A, 8B, 8C:
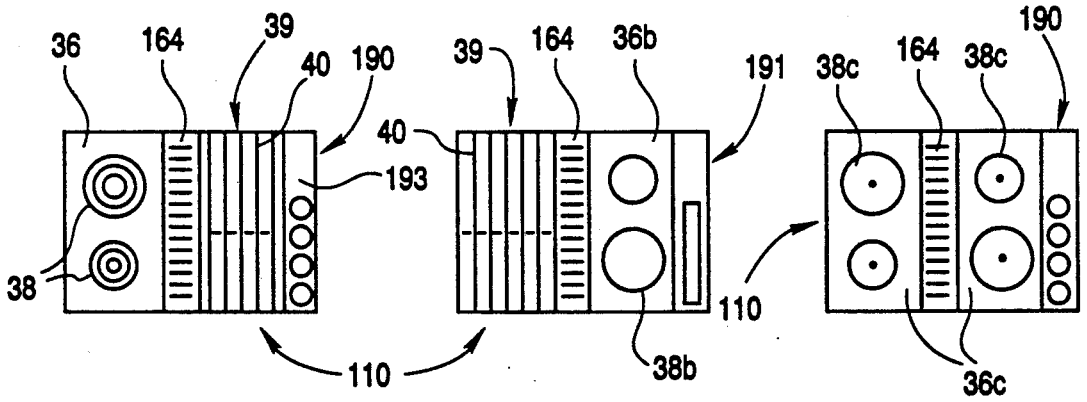
Figure 9B:
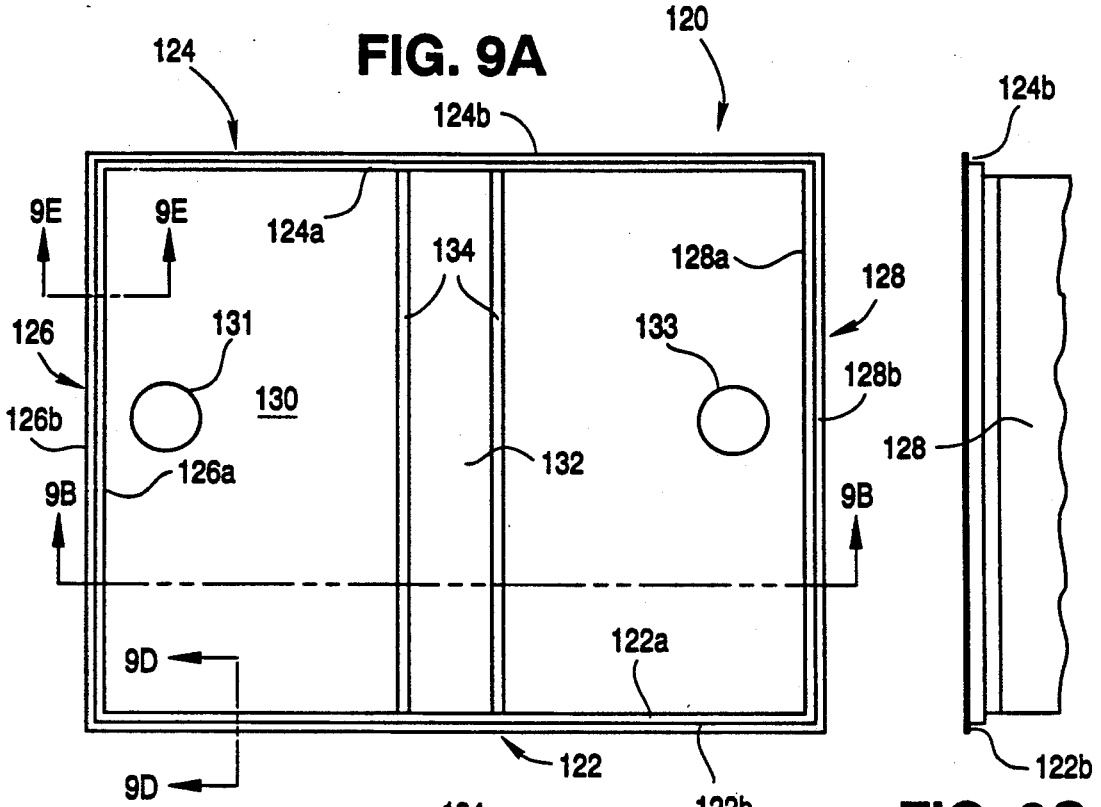
Figure 9B:
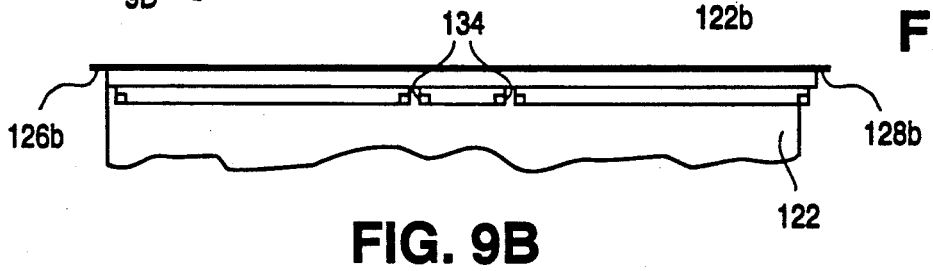
Figure 10:
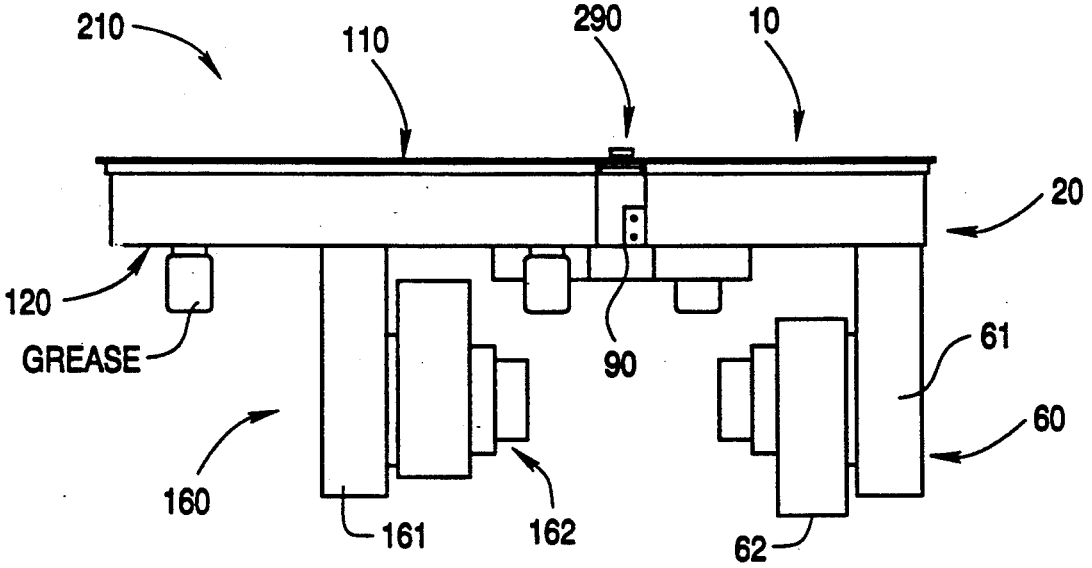
Figure 11A:
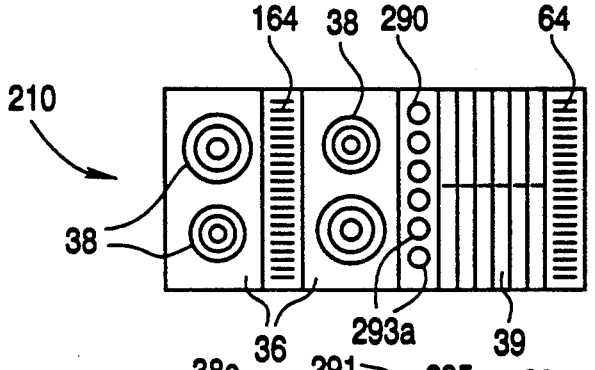
Figure 11B:
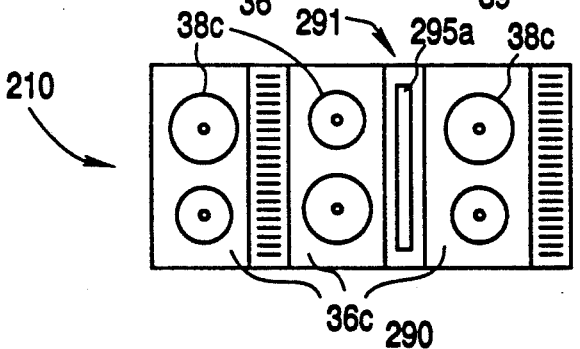
Figure 11C:
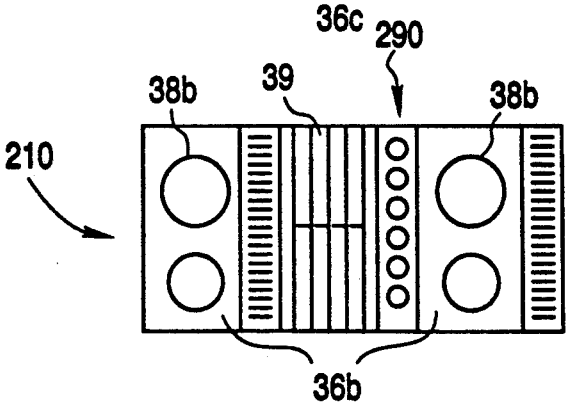
Figure 13A:
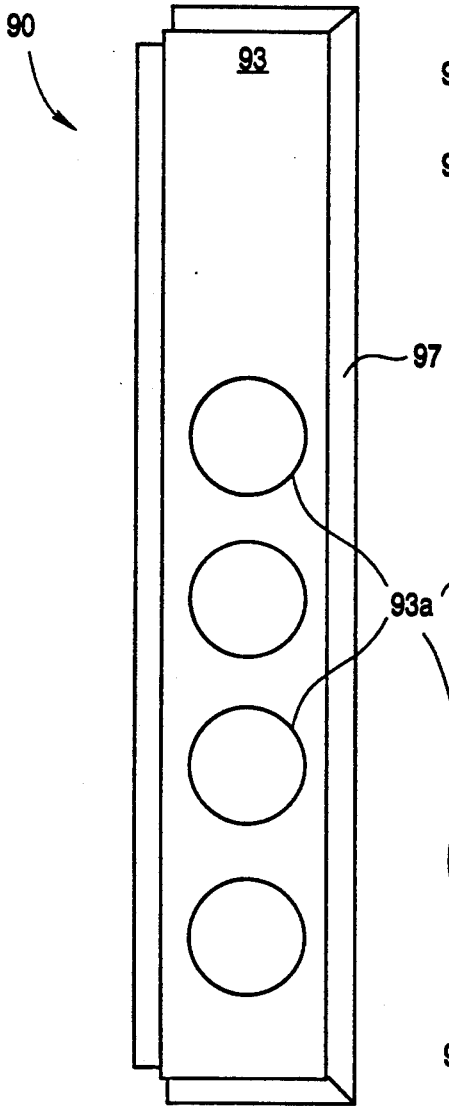
Figure 13B:
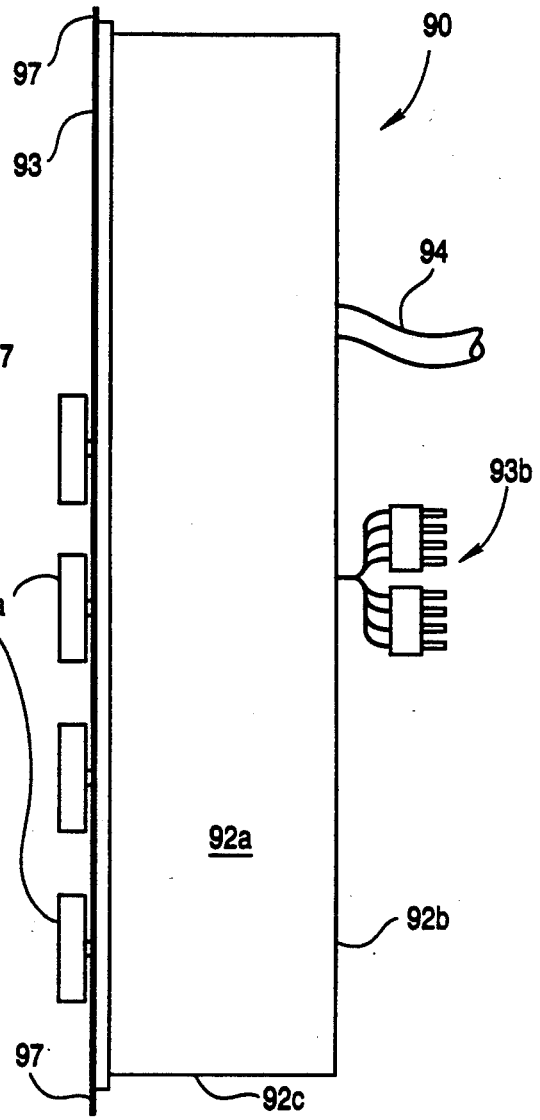
Figure 13C:
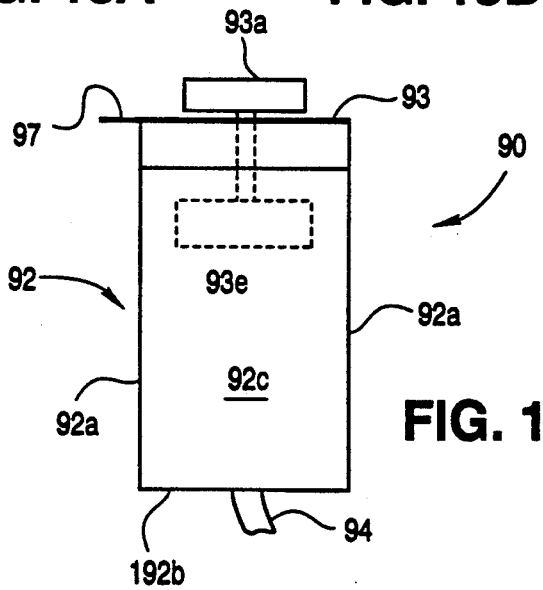

4A–4C illustrate modular components provided by this invention available to construct the single module cooking appliance;

FIGS. 5A and 5G are top plan views of a single burner box provided by this invention and FIGS. 5B–5F are isolated views of various parts of the burner boxes of FIGS. 5A and 5G;

FIG. 6 is a partially exploded and broken away perspective view of a double module cooking appliance provided by this invention illustrating the mounting thereof in a counter base;

FIG. 7 is a front plan view of the double module cooking appliance of FIG. 6;

FIGS. 8A–8C are top plan views illustrating some of the various configurations of double module cooking appliances provided by this invention;

FIG. 9A is a top plan view of a double burner box provided by this invention and FIGS. 9B–9E are isolated views of various parts of the burner box of FIG. 9A;

FIG. 10 is a side plan view of a triple module cooking appliance provided by this invention;

FIGS. 11A–11C are top plan views illustrating some of the various cooktop and control module configurations of triple module cooking appliances provided by this invention;

FIGS. 12A–12C illustrate modular components provided by this invention and used to construct a triple module cooking assembly like that shown in FIG. 10;

FIGS. 13A–13C are top, side and end plan views, respectively, of a control module provided by this invention;

FIGS. 14A–14C are bottom, end and side plan views, respectively, of a plenum forming means provided by this invention; and FIGS. 15A and 15B are views of an alternative embodiment of a cooking appliance provided by this invention illustrating the mounting of a double cooking unit in a counter base equipped with a remote control unit.

BEST MODE FOR CARRYING OUT THE INVENTION

The basic modular components of the countertop cooking appliance system of this invention include a cooking module, including a housing, such as a single unit as shown in FIGS. 5A–5G, or a double unit as shown in FIGS. 9A–9F, a control module, such as that shown in FIGS. 13A–13C, and, preferably, a plenum forming means for a ventilation system, such as that shown in FIGS. 14A–14C. These three or four basic modular components can be combined to provide a variety of countertop cooking appliances when combined with other standard components, such as various surface burners and controls, all as further described below.

Figure 1:
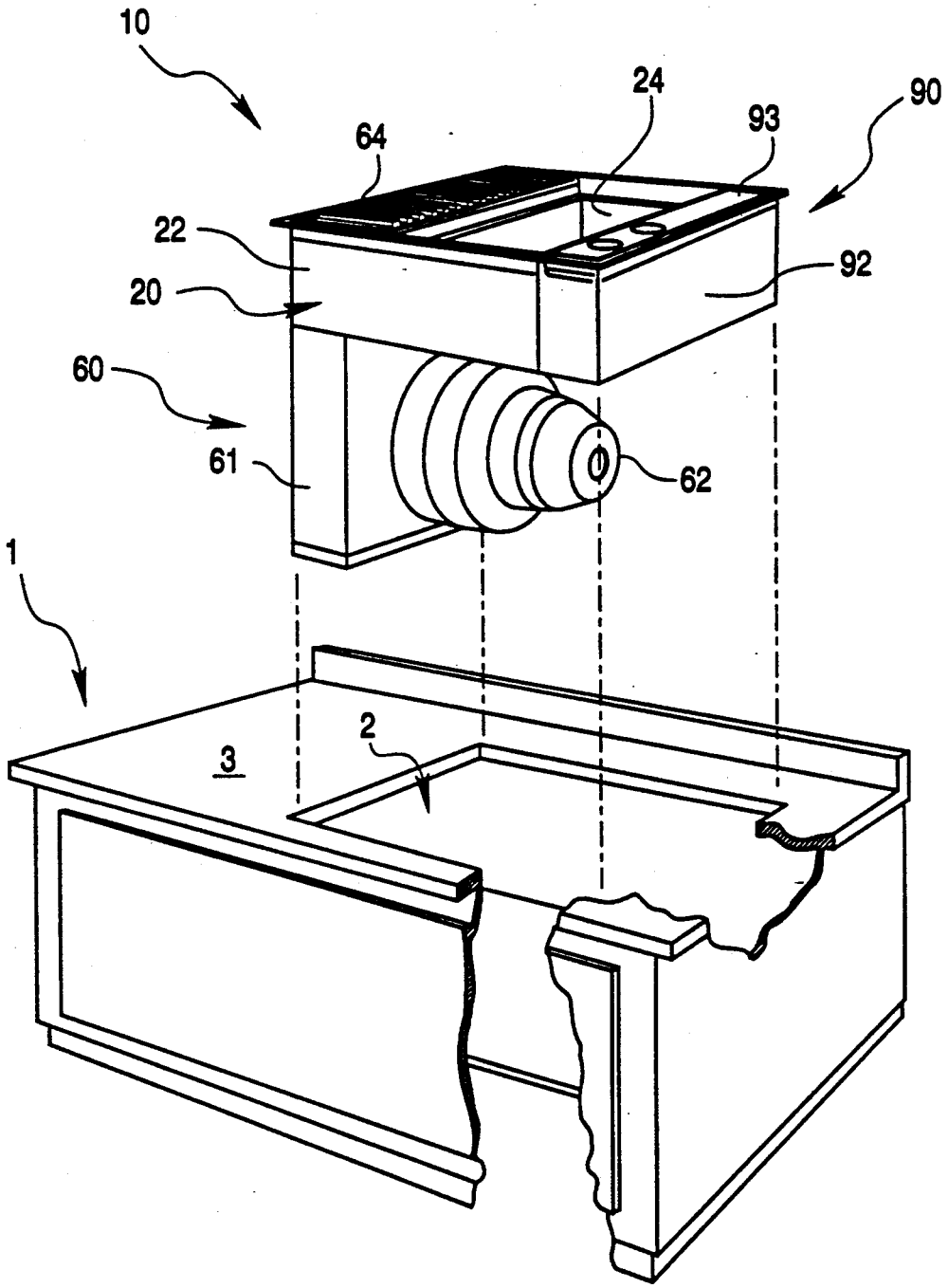
FIG. 1 is a partially exploded and broken away perspective view of a single module cooking assembly provided by this invention illustrating the mounting thereof in a counter base.

Referring now to FIGS. 1–5, a preferred embodiment of a single unit countertop cooking system or assembly 10 provided by this invention is shown generally comprising a cooking module, which includes a housing and burner box 20, a ventilation system 60, and a control unit or module 90, which includes an elongated housing or enclosure 92 and an upper face plate 93. Ventilation system 60 includes plenum forming unit 61 and a blower motor 62 for creating downdraft ventilation through and about the cooking assembly. Modular cooking assembly 10 is intended to be arranged within an opening 2 provided in a countertop 3 of a cabinetwork 1. FIG. 1 illustrates the single unit cooking system 10 absent any heating units that are normally operatively disposed therein.

The cooking system or assembly 10 comprises a housing and open top burner box 20, shown best in FIGS. 5A–5F, which includes a pair of faces 22 and 24, a pair of sides 26 and 28, and a bottom wall 30. The burner box 20 shown in FIG. 5A is oriented 180 degrees from its presentation in FIG. 1; thus, whereas face 22 appears in a front position in FIG. 1, it appears in a rear position or at the top of FIG. 5A. Indeed, as discussed further below, modular cooking assembly 10 may be disposed within the cabinetwork 1 in one of two orientations, which differ 180° from one another so that either face 22 or face 24 may be the front position when the modular cooking assembly 10 is installed in a countertop 1.

Figure 3:
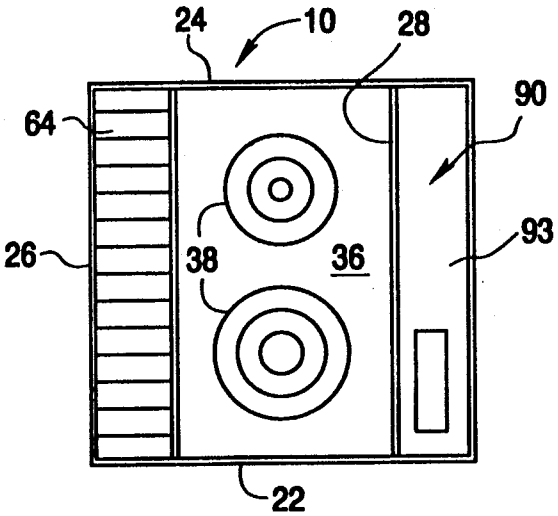
FIG. 3 is a top plan view of a particular cooktop configuration of a single module cooking assembly provided by this invention.

As shown best in FIG. 5A, the bottom wall 30 of burner box 20 is provided with an elongated opening 32 adjacent to side 26 and extending between faces 22 and 24 for receiving the plenum forming unit 61 (FIGS. 14A–14C). A second opening 30*a* is further provided in bottom wall 30 to accommodate a grease catching container (FIG. 2) therein. Burner box 20 is adapted to receive a heating unit, which may include a cooktop panel 36 having two surface burner elements 38 operatively carried therein, as shown in FIG. 3.

FIGS. 5B and 5C are partial side plan views of the housing and burner box 20 of FIG. 5A taken from the left side and from the right side, respectively. FIG. 5D is a partial cross sectional view taken at the plane 5D–5D of FIG. 5A. FIG. 5E is a partial cross sectional view of face 24 taken at the plane 5E–5E in FIG. 5A, and FIG. 5F is a partial cross sectional view of side 28 taken at the plane 5F–5F in FIG. 5A. While FIG. 5E shows only face 24, the following discussion also applies to face 22. Face 24 comprises a shoulder portion 24*a* and an integral peripheral trim portion 24*b*, both of which extend along the entire length of face 24. Concomitantly, face 22 includes a shoulder portion 22*a* and an integral peripheral trim portion 22*b*, both of which also extend along the entire length of face 22.

Side 28 shown in FIG. 5F similarly includes a shoulder portion 28*a* and an integral peripheral trim portion 28*b*, both of which extend along the entire length of side 28. Concomitantly, side 26 includes a shoulder portion 26*a* and an integral peripheral trim portion 26*b*, both of which also extend the entire length of side 26. While the cooktop panel 36 supported within burner box 20 does not extend completely between sides 26 and 28 because of the ventilation system 60, side 26 is constructed substantially identically to side 28 for manufacturing efficiency. Likewise, faces 22 and 24 are substantially identical. Faces 22 and 24, sides 26 and 28 and bottom wall 30 are preferably sheet metal components joined along their adjoining boundaries to define the burner box weldment.

Housing and burner box 20 further includes a bridge portion 34 which extends between faces 22 and 24 to serve as a support between the cooktop panel 36 and an exhaust manifold 64 arranged atop the plenum forming unit 61. As shown in FIG. 5D, bridge portion 34 extends downwardly into the burner box 20 only a very short distance (preferably less than one inch) and its upper surface 34*a* is arranged substantially flush with shoulder portions 22*a*, 24*a*, 26*a* and 28*a*. Bridge portion 34, in cooperation with shoulder portion 26*a* and portions of shoulder portions 22*a* and 24*a* adjacent to side 26 of the burner box 20 shown in FIG. 5A, coact to support exhaust manifold 64.

Preferably, the trim portions 22*b*, 24*b*, 26*b* and 28*b*, the shoulder portions 22*a*, 24*a*, 26*a* and 28*a* and the bridge portion 34 of burner box 20 are formed as a separate assembly (for example, by welding) which is fastened to the top of its burner box.

FIG. 5G illustrates a housing and burner box 20' for the manufacture of single unit cooktop appliances adapted for updraft ventilation. Housing and burner box 20' differs from the housing and burner box of FIG. 5A in the omission of the portion adapted to receive ventilation system 60 such as opening 32 and bridge portion 34. Housing and burner box 20' includes a pair of faces 22' and 24', a pair of sides 26' and 28', and a bottom wall 30'. The bottom wall 30' of burner box 20' is provided with an opening 30*a*' to accommodate a grease catching container (FIG. 2) therein. Burner box 20' is adapted to receive a heating unit, which may include a cooktop panel 36 having two surface burner elements 38 operatively carried therein.

FIGS. 5B and 5C also illustrate partial side plan views of the housing and burner box 20' of FIG. 5G taken from the left side and from the right side, respectively. Faces 22 and 24 and sides 26 and 28 of FIG. 5A have the same profiles as faces 22' and 24' and sides 26' and 28' of FIG. 5G. Both are represented in FIGS. 5E and 5F. As shown in FIG. 5G, FIG. 5E also represents a partial cross-sectional view of face 24' taken at the plane 5E-5E in FIG. 5G, and FIG. 5F also represents a partial cross-sectional view of side 28' taken at the plane 5F-5F in FIG. 5G. While FIG. 5E shows only face 24', the following discussion also applies to face 22'. Face 24' comprises a shoulder portion 24*a*' and an integral peripheral trim portion 24*b*', both of which extend along the entire length of face 24'. Concomitantly, face 22' includes a shoulder portion 22*a*' and an integral peripheral trim portion 22*b*', both of which also extend along the entire length of face 22'.

Side 28' shown in FIG. 5F includes a shoulder portion 28*a*' and an integral peripheral trim portion 28*b*', both of which extend along the entire length of side 28'. Concomitantly, side 26' includes a shoulder portion 26*a*' and an integral peripheral trim portion 26*b*', both of which also extend the entire length of side 26'. Side 26' is constructed substantially identically to side 28' for manufacturing efficiency. Likewise, faces 22' and 24', sides 26' and 28' and bottom wall 30' are preferably sheet metal components joined along their adjoining boundaries to define the burner box weldment.

Figure 2:
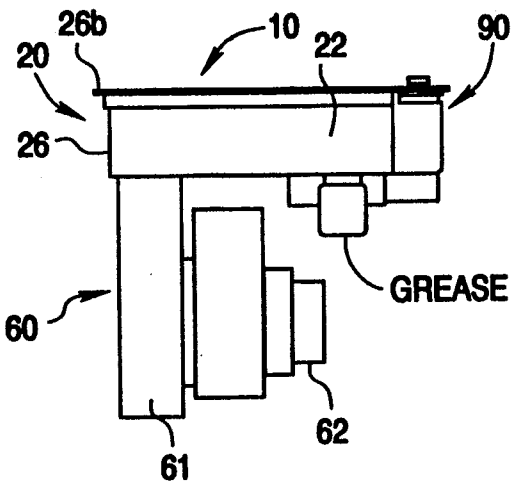
FIG. 2 is a front plan view of the single module cooking assembly of FIG. 1.
Figure 4C:
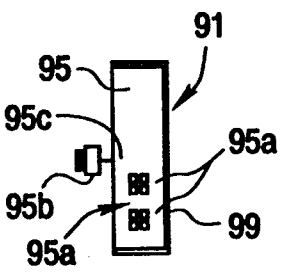
Figure 4B:
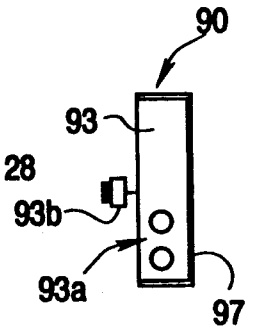
Figure 4A:
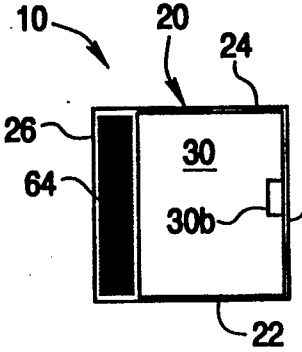

FIGS. 4A-4C illustrate the modular components provided by this invention to construct the countertop cooking assembly 10 shown in FIGS. 1-3. FIG. 4A is a top plan view of the cooking module and burner box 20 having faces 22 and 24, sides 26 and 28 and exhaust manifold 64 disposed over the plenum forming unit 6 (not shown). Control module 90, as shown in FIG. 4B, can include electromechanical controls carried by its upper face plate 93 and provide a plurality of manually operable control knobs 93*a*. An alternative electronic control unit 91 suitable for use with the countertop cooking appliance of this invention includes an upper face plate 95 which, as shown in FIG. 4C, is provided with a plurality of manually operable touchpad controls 95*a*. The control units of FIGS. 4B and 4C are electrically connectable to the heating units of the cooking assembly 10 and burner box 20 via conventional plug-in connectors 93*b* and 95*b*, respectively, which are receivable in an electrical plug-in receptacle 30*b* rigidly secured within the burner box 20. Electronic control unit 91 may also be provided with an optional food temperature probe 95*c*.

Face plates 93 and 95 of control units 90 and 91 of FIGS. 4B and 4C, respectively, are provided with integral peripheral trim portions 97 and 99, respectively, which, in cooperation with peripheral trim portions 22*b*, 24*b*, 26*b*, and 28*b* (FIG. 5) of burner box 20, act to support the modular cooking assembly 10 within the cabinetwork 1 and to provide the appearance of a unitary cooking appliance having a substantially flush countertop surface. As shown in FIGS. 1-4, control units 90 and 91 are adapted to be connected along their long sides to side 28 of the burner box 20, which may be at either the left or right of the cooking assembly 10 when installed. The control modules 90 and 91 are thus adaptable to accept and carry control components for energizing and controlling the ventilation system 60 and for simultaneously energizing and independently controlling the operation of the one or more heating elements included in the burner box 20 of the modular cooking assembly 10. Housing 92 and face plate 93 of the control modules are further discussed below with respect to FIGS. 13A-13C.

The embodiments of the present invention shown in FIGS. 1-5 comprise housing and burner boxes 20 and 20' for single unit cooking systems adapted to be arranged adjacent a control module 90 or 91 within an opening 2 provided in a countertop 3, and the burner boxes 20 and 20' and the control module 90 or 91 each include peripheral trim portions (22*b*, 24*b*, 26*b*, 28*b*, 22*b*', 24*b*', 26*b*', 28*b*' 97, 99) which overly the countertop 3 to support the cooking system or assembly within the countertop 3 and to provide the appearance of a unitary cooking appliance.

Referring now to FIGS. 6-9, a further preferred embodiment of this invention provides a double unit cooking system or assembly 110 including a housing 120, ventilation means 160, and control module 190. The cooking system or assembly 110 includes housing and burner box 120 and a centrally located ventilation means 160. FIG. 6 illustrates the double cooking system 110 absent any heating units operatively disposed therein. As shown in FIGS. 9A-9E, housing 120 includes faces 122 and 124, sides 126 and 128 and a bottom wall 130. Ventilation means 160 includes plenum forming unit 161, which is provided with a blower motor 162, which exhausts and provides ventilation for the cooking appliance. The double unit cooking assembly 110 is constructed so that the plenum forming unit 161 is positioned centrally within the burner box 120 enabling at least one modular heating unit to be operatively disposed between each end of the burner box 120 and the plenum forming unit 161.

As with the single unit embodiment discussed above, control module 190 comprises elongated control housing 192 having upper face plate 193 affixed thereto. Exhaust intake manifold 164 is arranged to cover the top opening of the plenum forming unit 161. The double cooking system 110 is intended to be supported within an opening 5 provided in a countertop 6 of a cabinetwork 4.

As further shown in FIGS. 8A-8C, this invention allows the construction of double unit cooking appliances of variable configuration. For example, in FIG. 8A, the left position of cooking system 110 comprises a cooktop panel 36 configured with two open coil surface burner elements 38 operatively supported therein while the right position carries a grilling unit 39 provided with an electrical broil heating element (not shown) operatively carried within the burner box 120 below the cooking grid 40. In the cooking system configuration shown in FIG. 8B, grilling unit 39 is arranged in the left position of the cooking system 110 and a smooth cooktop panel 36*b* could include radiant or halogen heating elements 38*b* arranged at the right position. An electronic control unit 191 (shown generically by an elongated rectangle) can be included in the double unit cooking system 110. In the configuration of FIG. 8C, a pair of cooktop panels 36*c* equipped with solid surface burner elements 38*c*, for example, are disposed on both sides of the exhaust manifold 164 and electromechanical control unit 190 is arranged adjacent to the end of the cooking unit. Control units 190 and 191 employ the controls necessary to operate the heating units and ventilation systems of the variously configured double unit appliances.

Figure 9D:
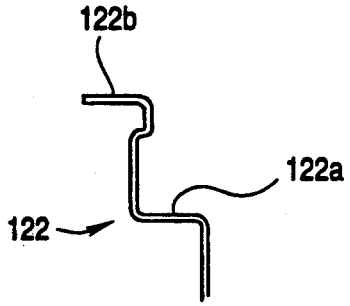
Figure 9E:
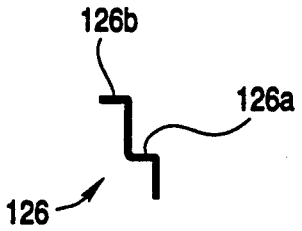

Referring now to FIG. 9A, a top plan view of housing and burner box 120 is presented and isolated views of selected parts of the housing 120 are shown in FIGS. 9B-9E. Housing 120 comprises faces 122 and 124, sides 126 and 128, a bottom wall 130, a pair of bridge portions 134, circular openings 131 and 133, and an elongated opening 132 formed in the central portion of bottom wall 130. Circular openings 131 and 133 are intended to each accommodate a grease containing container (FIG. 7) and elongated opening 132 is intended to receive therein plenum forming unit 161. Face 122, as shown in FIG. 9D, is formed with a shoulder portion 122*a* and an integral peripheral trim portion 122*b*. While not shown in cross section, face 124 is provided with a similar construction having a shoulder portion 124*a* and an integral peripheral trim portion 124*b*. Side 126, as shown in FIG. 9E, is formed with a shoulder portion 126*a* and an integral peripheral trim portion 126*b*. Again, while not shown in cross section, side 128 is also provided with a similar construction having a shoulder portion 128*a* and an integral peripheral trim portion 128*b*. Trim portions 122*b*, 124*b*, 126*b* and 128*b* overlie the countertop of the cabinetwork and support the cooking assembly 110 within the countertop opening 5 and provide a unitary appearance thereto. Cooktop panels 36, 36*b* and 36*c* (FIGS. 8A-8C) are operatively disposed within the burner box 120 and are supported about their peripheries by a combination of shoulder portions 122*a*, 124*a*, 126*a* and 128*a* and bridge portions 134.

Preferably, shoulder portions 122*a*, 124*a*, 126*a* and 128*a*, trim portions 122*b*, 124*b*, 126*b* and 128*b*, and bridge portions 134 of housing 120 are formed by a separate assembly (for example, by welding), which is fastened to the top of its burner box 120.

While burner box 120 is shown in FIG. 6 with face 122 located in the front position, the burner box is symmetrical about a vertical central axis 112 (FIG. 7) extending therethrough. Thus, either of faces 122 or 124 may be located in the front of the cooking system or assembly 110 when installed. With the control housing 192 and face plate 193 extending the entire depth of burner box 120, the control unit 190 may be affixed to either side 126 or 128 of burner box 120 and may accommodate a user's desire for location of the controls at the left or the right of the appliance when installed.

Double unit cooktop appliances adapted for updraft ventilation can be manufactured by omitting opening 132 and bridges 134 from housing and burner box 120, shortening faces 122 and 124 by the distance needed to accommodate the downdraft Ventilation system 160, and providing a supporting flange for heating units transversely through the center of the double housing and burner box between faces 122 and 124.

The double unit cooking module and control module of the present invention allows one to construct a cooking system or assembly 110 of desired configuration having a flush fitting unitary appearance within a countertop surface.

Further embodiments of countertop cooking appliances available through use of the present invention are shown in FIGS. 10 and 11. A triple unit cooking system or assembly 210 shown in FIGS. 10 and 11 comprises a double unit cooking system 110 disposed adjacent to a single unit cooking system 10 with an appropriate control unit 290 interposed therebetween. Cooking systems 10 and 110 are substantially identical to the cooking units shown in FIGS. 2 and 7, respectively, and include two downdraft ventilation means 60 and 160. In the construction of triple unit cooking system 210, a double unit housing and burner box 120 and single unit cooking module 20 are fastened to a control module 290 by conventional means, which can include welding, sheet metal screws, bolts and nuts, and the like.

Cooking assembly 210 is intended to have at least one modular heating unit operatively disposed in the left position of the first burner box 120, a second modular heating unit disposed in the right position of burner box 120, and at least one modular heating unit disposed within single burner box 20. FIGS. 11A-11C are top plan views presenting illustrative samples of the various cooking appliance configurations of triple unit cooking assembly 210 made available by this invention. For example, cooking assembly 210 shown in FIG. 11A contains cooktop panels 36 in the left and middle positions, with each cooktop panel having two surface burner elements 38 operatively disposed therein, and grilling unit 39 operatively disposed in the right position. In the configuration of FIG. 11A, exhaust manifolds 164 and 64 sit atop plenum forming units 161 and 61, respectively. Control unit 290 is an electromechanical control module with a plurality of control knobs 293*a* for selectively energizing and controlling the operation of surface burner elements 38, grilling unit 39 and blower motors 62 and 162 of the ventilation systems 60 and 160, respectively.

FIG. 11B presents a further alternative cooktop configuration in which the grill unit 39 has been replaced by cooktop panel 36*c* in the right position. The difference in the depiction of the surface burner elements 38*c* in FIG. 11B from those of FIG. 11A indicates that the burner elements 38*c* of FIG. 11B are of a different type than those of FIG. 11A and correspond to those shown in FIG. 8C. It may also be noted that, as with conventional stovetop appliances, one surface burner element, normally the rear element, is generally larger in diameter than the other element within a single cooktop panel. Cooking assembly 210 of FIG. 11B includes an electronic control unit 291, operatively arranged between the burner boxes, which is provided with electronic touchpad controls 295*a* shown generically in block form.

FIG. 11C presents an even further alternative cooktop configuration of cooking appliance 210 including cooktop panel 36*b* having burner elements corresponding to 38*b* shown in FIG. 8B and disposed adjacent each end of cooking appliance 210 and grilling unit 39 and electromechanical control module 290 arranged therebetween. As shown in FIGS. 11A–11C, the cooking appliance assembly provided by this invention provides a versatile cooking arrangement that allows the user to select many combinations of modular options to present the appearance of a unitary cooking appliance.

FIGS. 12A–12C illustrate some of the modular components provided by this invention to construct the triple unit cooking system 210 shown in FIG. 10. FIG. 12A shows electromechanical control unit 290 comprising control knobs 293*a* arranged atop upper face plate 293, a first electrical plug-in connector 293*b* and a second electrical plug-in connector 293*e*. With reference to FIG. 10, control unit 290 of FIG. 12A is intended to be arranged so that the plug-in connector 293*b* would be operatively connected to burner box 120 in the left position while second electrical plug-in connector 293*e* would be operatively connected to burner box 20 in the right position.

FIG. 12B shows electronic control unit 291 of FIG. 11B comprising a plurality of manually operable touchpad controls 295*a* for selectively energizing and controlling the operation of the heating elements and ventilation means included in the cooking assembly 210, a first electrical plug-in connector 295*b* and a second electrical plug-in connector 295*e*, both of which connectors are similar to connectors 293*b* and 293*e* of FIG. 12A, and both of which connectors electrically connect control unit 291 with the respective burner boxes constituting the cooking assembly 210 shown in FIG. 10. If desired, electronic control unit 291 may further include a food temperature probe 295*c*. FIG. 12C presents a top plan view of the burner boxes 20 and 120 arranged adjacent to each other to define the triple unit cooking system or assembly 210 of FIG. 10, the length "d" of which is preferably approximately 41.62 inches when fully assembled.

Each of the control units discussed herein are housed in an elongated enclosure 92, which is substantially identical for each such control unit. The control module enclosure 92 shown in FIGS. 13A–13C comprises an open-topped sheet metal box that extends the full depth of the burner boxes, and its long sides are adapted for connection to the sides of the burner boxes 20 and 120. The electrical control components are housed within each enclosure 92 and are preferably carried by the control module face plate 93 which fits on and closes the open top of enclosure 92. The number of control knobs or touchpad controls will, of course, differ with the number of heating elements and with the ventilation systems included in the particular cooking appliance. Thus, while an electromechanical control unit 90 shown in FIG. 13A may include four control knobs 93*a*, such controls are exemplary only and control unit 90 may be provided with two or six control knobs or touchpads, accordingly.

As described above, control unit 90 comprises elongated enclosure 92 and upper face plate 93 which sits atop enclosure 92. Enclosure 92 includes long sides 92*a*, a bottom wall 92*b* and opposing ends 92*c*, all of which collectively define an upwardly facing elongated box-type enclosure 92, which is closed by face plate 93 fastened at its top. Each control knob 93*a* (or touchpad control) operates accompanying control circuitry, shown in phantom line as reference numeral 93*e* in FIG. 13C. The control circuitry 93*e* of each knob 93*a* is connected to and operates one of the heating units and the blowers included in the cooking assembly. A detailed description of such control means and circuitry is not provided because it is well known to those skilled in the art.

As shown in FIG. 13B, a control unit 90 includes a power conductor 94, for connecting the cooking assembly to an electrical energy source. Plug-in connector 93*b* may be of the conventional type to provide an electrical connection between the controls of control unit 90 and the heating units and the ventilation means provided in the cooking assembly.

An important feature of control unit 90 of this invention is the provision of the integral peripheral trim portion 97 arranged about three quarters of the periphery of face plate 93. When the control unit 90 is arranged adjacent the cooking modules provided by this invention, peripheral trim portion 97 overlies the countertop of the cabinetwork and coacts with the peripheral trim portions provided on the sides and faces of the cooking module housings to provide a flush trim design across their interface, which gives the appearance of a unitary cooking appliance supported within the countertop.

A suitable plenum forming means 61, used with ventilation means 60 in preferred embodiments of this invention, is shown in FIGS. 14A–14C. Plenum forming means 61 generally comprises a chamber having narrow end walls 63*a*, side walls 63*b* and a bottom wall 67. One of the side walls 63*b* is provided with an opening 66 formed therein for receiving the ventilation blower motor 62 on a shoulder 69 of a frustoconical flange portion 68. Blower motor 62, which is provided with a power conductor for connection to an electrical energy source, may be fastened to flange 68 by conventional means, such as metal screws, nuts and bolts and the like. One or both of side walls 63*b* may be provided with vent openings 70 formed therein adjacent the upper edge 61*a*. Additionally, a shoulder portion 65 is arranged along the entire length of each opposing side wall 63*b*. Shoulder portion 65 may be provided with an L-shaped flange spot-welded to the plenum forming means 61.

As described above, plenum forming means 61 may be received within elongated openings 32 and 132 formed in the bottom wall of the cooking module burner boxes 20 and 120. Shoulder portions 65 are adapted to support the plenum forming means 61 within the burner boxes 20 and 120 by their lower surfaces 65*a*, which rest against the periphery of the plenum-receiving openings 32 and 132 of the bottom walls of the burner boxes. With this arrangement, the upper edge 61*a* of plenum forming means 61 is located below and adjacent to the upper edges of the sides and faces of the burner boxes when fully assembled, and the exhaust air intake manifold 64 is supported over the upper edge 61*a* of the plenum forming means 61. The plenum forming means 61 may be securely fastened within the elongated openings 32 and 132 of the burner boxes 20 and 120 by conventional fasteners, such as sheet metal screws, and the like, placed along the shoulder portions 65*a* and/or at end walls 63*a* so that the end walls are fastened against the opposing faces of the burner boxes.

In operation, the downdraft ventilation system concurrently draws combustion products and vapors produced during cooking from around the cooking food, away from the cooking surface and down through the plenum forming means 61 and exhausts the vapors to atmosphere via duct means (not shown). The duct means may be arranged up an inside wall to a roof or overhang, between floor joists to an outside wall, directly from the cooking assembly to an outside wall, and so on.

An even further embodiment of a countertop cooking assembly 310 provided by this invention is illustrated in FIGS. 15A–15B comprising a double cooking system 110, which includes double burner box 120 and downdraft ventilation means 160, which in turn preferably includes plenum forming unit 161 and blower motor 162, and a remotely disposed control unit 390. Cooking assembly 310 is adapted to be supported within an opening 305 provided in a countertop surface 306 of a cabinetwork 304. This alternative embodiment includes a remotely located control unit 390 mounted on the front of cabinetwork 304. Control unit 390 is electrically connected to the heaters of burner box 120 via a plug-in connector **393*b*. In all other respects, the control module of unit 390** is substantially identical to the control modules described above. Such an alternative embodiment may include any combination of a single module, double module, or triple module cooking unit and a control module (with electromechanical or electronic controls) arranged remote from the cooking unit.

For aesthetic purposes, the upper face plate 93 of the control module 90 provided by this invention may be available in white, black or stainless steel to accommodate the surroundings in which the cooking system is to be arranged. The cooking system may also include a LED display to provide the cook with cooking information; easy to read indicator lights to indicate which heating elements are activated; timer means; temperature level control; downdraft ventilation system blower speed control; and the like. The electronic control module may include the optional food temperature probe so that when the internal food temperature reaches a predetermined level, a signal is generated.

The surface burner elements 38, **38*b* and 38*c* suitable for employment with the modular cooktop panels 36** provided by this invention are numerous. Such elements may include a halogen cartridge with a circular single lamp infra-red heater; a quick start radiant cartridge having two instant-on heating elements with unexposed coils; cast-iron solid heating elements; and conventional electric coils. A griddle accessory may also be made available. The modularity of appliances provided by this invention allows an operator to switch from various cooktop panels and/or grilling units without undue effort. An operator may change the configuration of a cooking appliance by simply unplugging and removing a cooktop panel or grilling unit from the burner box and inserting and plugging in a new cooktop panel or grilling unit in the burner box.

The grilling unit used with appliances provided by this invention generally includes a liner pan within the burner box arranged between the electric broil heating element and the bottom wall of the burner box to catch cooking liquids that may drip from above. The liner pan can catch the fluids and direct them to a grease container. While the food cooks on the grill grate, juices are allowed to drop down to the grill liner pan, where they are transformed into smoke, which then rises to give the food a grilled flavor. The downdraft ventilation system then whisks the smoke away through the duct work and out of the dwelling.

The invention thus provides basic components from which a variety of cooking appliances may be constructed. By combining cooking modules and control modules of this invention, any one of a variety of cooking appliances may be constructed for use with auxiliary ventilation systems. By preferably combining a cooking module, a control module and plenum forming means, as described above, any one of a variety of downdraft ventilated cooking appliances may be constructed, and, as further described above, by providing a double unit cooking module and a single unit cooking module, the variety of cooking appliances can be extended to single unit, double unit, triple unit, and even more extended cooking appliances, each with appropriate control means carried by one or more control modules.

The versatility provided by the modular components of this invention provides flexibility of configuring a cooking appliance as the user so desires, and when installed, the cooking appliances resulting from this invention provide a decorative design which presents the appearance of a unitary cooking appliance arranged within and flush with the countertop.

The drawings and specification above have set forth preferred embodiments of the present invention and, although specific terms are employed to describe the preferred embodiments, such terms are used in their descriptive sense only and not to limit the spirit or scope of the invention, which is limited only by the prior art and the following claims.

What is claimed is:

1. A countertop cooking appliance system including modular components, comprising:

at least one cooking module including a box-like, open-top housing and at least one heating apparatus, said cooking module being free of controls for energizing or controlling said heating apparatus and a control module for carrying controls for controlling said heating apparatus, including a box-like, open-top control housing separate from said cooking module, a side of said control housing providing a connection for said control module to one side of said box-like, open-top housing of said cooking module, said control module and cooking module providing means for interconnection to provide substantially coplanar open-tops when connected and operation of said heating apparatus with substantially coplanar controls.

2. The countertop cooking appliance system as defined in claim 1 wherein said cooking module housing includes a peripheral trim adapted to overlie said countertop, and wherein said control module housing includes trim adapted to overlie said countertop and in cooperation with said peripheral trim of said cooking module housing to provide the appearance of a unitary cooking appliance.

3. The countertop cooking appliance system of claim 1 further comprising downdraft ventilation means adapted for connection to said cooking module housing and wherein said control module also carries controls adapted for operation of said downdraft ventilation means.

4. The countertop cooking appliance system as defined in claim 3 wherein said downdraft ventilation means is positioned centrally within said cooking module housing and wherein said cooking module housing contains at least one heating apparatus between each end of the cooking module housing and the downdraft ventilation means.

5. The countertop cooking appliance system as defined in claim 3 wherein said downdraft ventilation means is positioned at one side of said cooking module housing and said control module housing is positioned juxtaposed to the other side of said cooking module housing.

6. A modular cooktop system of variable configuration, comprising:

a separate cooking unit including an open top burner box formed by a pair of faces, a pair of sides and a bottom;

a separate plenum forming unit including a blower to provide ventilation for said cooking unit, said burner box including means to receive said plenum forming unit across said burner box between said pair of faces and one or more heating units juxtaposed to said plenum forming unit; and a separate control unit including an elongated control enclosure with long sides, and means for interconnecting said control unit to a side of said burner box, said control enclosure including means to receive one or more heating unit controls.

7. The modular cooktop system of claim 6 wherein said burner box includes an opening in the bottom to receive said plenum forming unit in the central portion of said burner box, said one or more heating units being located on each side of said plenum forming unit.

8. The modular cooktop system of claim 6 wherein said burner box includes an opening in the bottom along one side of said burner box to receive said plenum forming unit.

9. The modular cooktop system of claim 7 wherein an additional burner box, including an opening formed in the bottom along one side thereof to receive an additional plenum forming unit, is attached at its side opposite the opening for said plenum forming unit to one of the sides of said first mentioned burner box.

10. The modular cooktop system of claim 6 wherein a peripheral trim is attached to said pair of faces and pair of sides of said burner box adjacent its open top, and wherein a trim strip is attached to said elongated control enclosure of said control unit, said peripheral trim of said cooking unit and said trim strip of said control unit coacting to interface and provide a unitary trim appearance across their face.

11. A countertop cooking appliance system including modular components, comprising:

at least one cooking modular including a box-like, open-top housing including a downdraft ventilation means in said housing, said housing including at least one heating apparatus, said cooking module being free of controls for energizing or controlling said heating apparatus and said downdraft ventilation means;

a selectable control module including a housing separate from said cooking module housing and juxtaposed and connected to said cooking module, said control module including manually adjustable controls for controlling said heating apparatus and said downdraft ventilation means;

means for connecting an energy source to said control module; and means for connecting said control module to said cooking module to selectively provide energy thereto.

12. The countertop cooking appliance system as defined in claim 11 wherein said cooking module housing includes peripheral trim overlying said countertop, and wherein said control module housing includes trim overlying said countertop, said control module housing trim cooperating with said cooking module housing peripheral trim to provide the appearance of a unitary cooking appliance.

13. A countertop cooking appliance system including modular components, comprising:

at least one cooking module including a housing and at least one heating apparatus, said cooking module being free of controls for energizing or controlling said heating apparatus;

a downdraft ventilation means connected at one side of said cooking module housing; and a control module, including a control housing separate from said cooking module housing, juxtaposed and connected to another side of said cooking module and carrying controls for controlling the heating apparatus and downdraft ventilation means, said control module including means for operation of said heating apparatus and said downdraft ventilation means.

14. A modular cooking appliance system adapted to be received and supported within an opening provided in a countertop, comprising:

at least one cooking module including a housing including a peripheral trim in position to overlie the countertop and at least one heating apparatus, said cooking module being free of controls for energizing or controlling said heating apparatus; and a control module, including a control housing separate from said cooking module, juxtaposed to one side of said cooking module and including controls for controlling said heating apparatus and a trim strip positioned to overlie the countertop and mate with the peripheral trim of the cooking module housing;

means for connecting said housing of said control module to said cooking module for providing, when connected, the appearance of a unitary cooking appliance.

* * * * *